US009266645B2

(12) United States Patent
Eding

(10) Patent No.: US 9,266,645 B2
(45) Date of Patent: Feb. 23, 2016

(54) SYSTEM FOR CREATING A CONTAINER AND A CONTAINER

(71) Applicant: NEFAB AB, Jönköping (SE)

(72) Inventor: Pontus Eding, Edsbyn (SE)

(73) Assignee: NEFAB AB, Jönköping (SE)

( * ) Notice: Subject to any disclaimer, the term of this patent is extended or adjusted under 35 U.S.C. 154(b) by 0 days.

(21) Appl. No.: 13/903,487

(22) Filed: May 28, 2013

(65) Prior Publication Data

US 2013/0318782 A1 Dec. 5, 2013

(30) Foreign Application Priority Data

May 29, 2012 (EP) ..... 12169774

(51) Int. Cl.

| | |
|---|---|
| ***B65D 25/00*** | (2006.01) |
| ***B65D 6/16*** | (2006.01) |
| ***B65D 6/26*** | (2006.01) |
| ***B65D 6/24*** | (2006.01) |

(52) U.S. Cl.

CPC *B65D 25/00* (2013.01); *B65D 7/24* (2013.01); *B65D 7/32* (2013.01); *B65D 9/12* (2013.01); *B65D 9/24* (2013.01); *B65D 11/1873* (2013.01); *Y10T 29/53* (2015.01)

(58) Field of Classification Search

CPC ..... B65D 19/06; B65D 19/08; B65D 19/12; B65D 19/16; B65D 7/32; B65D 9/22; B65D 7/30; B65D 7/24; B65D 9/12; B65D 11/1873; B65D 11/18; B65D 11/1866; Y10T 29/53443

USPC ..... 220/6, 7, 4.28, 617; 206/600

See application file for complete search history.

(56) References Cited

U.S. PATENT DOCUMENTS

| | | | | |
|---|---|---|---|---|
| 3,940,007 | A * | 2/1976 | Griffiths | 220/4.28 |
| 4,452,366 | A * | 6/1984 | Nagai et al. | 220/4.01 |
| 4,453,471 | A | 6/1984 | Harrington et al. | |
| 4,690,571 | A * | 9/1987 | Fulterer | 384/22 |
| 4,890,740 | A * | 1/1990 | Tabler | 206/509 |
| 5,505,323 | A * | 4/1996 | Naoki et al. | 220/4.28 |
| 5,597,084 | A * | 1/1997 | Parasin | 220/4.28 |
| 5,918,755 | A * | 7/1999 | Warn | 220/4.09 |
| 6,216,899 | B1 * | 4/2001 | Vicari | 220/1.5 |
| 8,708,178 | B2 * | 4/2014 | Kvols et al. | 220/4.33 |
| 2011/0155729 | A1 * | 6/2011 | Hall | 220/4.28 |

FOREIGN PATENT DOCUMENTS

| | | | | |
|---|---|---|---|---|
| EP | 694012 | B1 | 1/1996 | |
| FR | 2661656 | A1 | 11/1991 | |
| WO | WO 9424007 | A1 * | 10/1994 | B65D 19/16 |

* cited by examiner

*Primary Examiner* — Fenn Mathew
*Assistant Examiner* — Chetan Chandra
(74) *Attorney, Agent, or Firm* — Dilworth & Barrese, LLP.

(57) ABSTRACT

A system for creating a container having a bottom and four lateral walls comprises a bottom member (1), four walls (2) and an arrangement (3) for interlocking said walls with respect to said bottom member so as to create a container. The arrangement comprises for each wall a first section (4) and the bottom has for each outer border thereof a second section (10). The second section allows introduction of the first section therein with a corresponding wall tilted outwards from a center of a container to be created and has a part (12) forming a stop to the first section preventing lifting of the wall with respect to the bottom member in a vertical position of the former.

18 Claims, 3 Drawing Sheets

SYSTEM FOR CREATING A CONTAINER AND A CONTAINER

TECHNICAL FIELD OF THE INVENTION AND BACKGROUND ART

The present invention relates to a system for creating a container having a bottom and four lateral walls, said system comprising a first plate-like member, hereinafter bottom member, configured to form a bottom of a container, four second plate-like members, hereinafter walls, configured to form lateral walls of a container, and an arrangement for interlocking said walls with respect to said bottom member so as to create a container in an assembled state, as well as a container made from such a system.

Thus, such a system is used for creating a container having a parallelepipedic shape, and such a container may include other elements than said bottom, lateral walls and interlocking arrangement for example a lid.

The material of the members for forming said bottom and the lateral walls may be of any suitable type, such as plywood, plastic and metal.

A system of this type having a said arrangement in combination with said members can be used for creating a container for transport of objects therein and after that by operating said arrangement releasing said members with respect to each other for getting disposed of said members or sending them back as a substantial flat package.

It is then important to be able to easily obtain an assembled state of a container created by use of such a system while reliably define that state and allow disassembly of the container in a simple manner with a minimum of damage of the different elements (including said members) of said system.

SUMMARY OF THE INVENTION

The object of the present invention is to provide a system of the type defined in the introduction addressing the needs declared above of such a system.

This object is according to the invention obtained by providing such a system with the features:

that said arrangement is configured to enable interconnecting and disconnecting said walls with respect to said bottom member for assembly and disassembly of said container by moving said walls with respect to said bottom member, and that said arrangement comprises for each said wall a first elongated plate-material section secured to that wall while extending along an edge thereof to form a lower edge of a lateral wall in said assembled state, and for each outer border of the bottom member a second elongated plate-material section secured to this bottom member while extending along the respective said outer border, each said second section having a first part extending substantially perpendicularly to a large surface of said bottom member designed to form a bottom of a container for extending substantially vertically upwards from said surface when placing said bottom member substantially horizontally, that each said second section has a second part configured to allow introduction of said first section into the second section from above, assuming said bottom being placed substantially horizontally, with the corresponding wall tilted outwards from a centre of a container to be created by at least 20° from a vertical extension, to form a stop to said first section preventing lifting of said wall with respect to said bottom member in a vertical position of the former to be obtained upon said introduction by tilting the wall with respect to the bottom member, that said first part of the second section is designed to provide support for the first section so as to prevent further tilting of said wall than to said vertical position and define said assembled state, and that said sections are designed to enable disassembling of the container by tilting said walls outwards with respect to the bottom member to a position in which said second part of said second section allows lifting of said first section out of said second section.

By providing the lateral wall members with a said first section and the bottom member with a said second section so designed interconnecting and disconnecting of the walls with the bottom member may be obtained by simply moving said walls with respect to said bottom member while ensuring that the assembled state is reliably defined with respect to the mutual positions of a wall and said bottom member and thanks to said stop formed by the second section preventing lifting of the wall extending vertically with respect to the bottom. Furthermore, disassembly is easily obtainable by tilting the wall sufficiently outwards from a centre of the container and then lifting said first section out of said second section without any damage of any elements of the system.

According to an embodiment of the invention said second part of each said second section is configured to allow said introduction of said first section into said second section and lifting of the former out of the latter for a range of angles of said tilting having a width of at least 20°, 40°, 60° or 70°. A broad such range not requiring the achievement of a well defined angle facilitates and speeds up an assembly and disassembly of a container. The introduction may for instance be obtained by laying a wall substantially horizontally with the first section thereof into the corresponding second section of the bottom member and then tilting the wall upwards towards a vertical position, or the introduction may be carried out while having the wall tilted by an angle of for instance 40° with respect to a vertical extension thereof and then tilting it to the vertical position according to which is most preferred in the respective situation.

According to another embodiment of the invention said second part of each second section comprises a mid portion connecting to said first part while extending substantially perpendicularly thereto in a direction outwards from a said centre of a container to be created while resting on said bottom member and an end portion connecting to said mid portion opposite to said first part, pointing upwards when placing said bottom member substantially horizontally, making an angle with respect to said bottom member of less than 80° and configured to define said stop for said first section. The presence of said mid portion of said second part of said second section enables suitable receipt of said first section in said second section, and said stop for lifting the first section out of said second section is formed in a preferred way by a said end portion.

According to another embodiment of the invention each said first section has a first part extending along a wall surface of a said wall downwards to bear against said first part of a said second section in said assembled state as well as a second part connecting to said first part of the first section and configured to bear upon said mid portion of said second section and extend substantially horizontally in said assembled state, and said end portion of each second section is configured to keep said first section inside said second section in a vertical position of the wall by preventing said second part of the first section to be lifted with respect to the bottom member. A well defined vertical position of a wall of a disassembled container without any possibility to remove the wall from the bottom member by lifting it therefrom is so obtained.

According to another embodiment of the invention each said end portion makes an angle of 80°-40°, 80°-60° or 70°-60° with said mid portion, which results in a possibility to efficiently keep said first section irremovable from said second section in a state in which a said wall extends substantially perpendicularly or perpendicularly to a said bottom member.

According to another embodiment of the invention each said second section has a support portion configured to provide support from below to a lower edge surface of a said wall in said assembled state. This increases a possible load applied from above onto a said wall to be taken without causing any damage of any part of said interlocking arrangement and maintaining stability of the container.

According to another embodiment of the invention said support portion is formed by an end of said end portion remote to said mid portion of said second section, and that end portion is then preferably bent back towards said mid portion for increasing the strength of said end portion, which increases said further possible load to be taken without any negative influence upon said interlocking arrangement.

According to another embodiment of the invention each said second section is secured from above to said bottom member. This means that said second sections may be firmly attached to said bottom member by suitable means, such as screws.

According to another embodiment of the invention said first part of each said first section is secured to a said wall surface to form an inner wall surface of a container in said assembled state. A reliable definition of the assembled state is facilitated by this feature.

According to another embodiment of the invention said first and second sections are made of elongated metal plates shaped. This enables a production of said interlocking arrangement by simple means to a low cost while obtaining a reliable function thereof.

According to another embodiment of the invention the system also comprises means configured to mutually interconnect adjacent said walls, and said means comprises according to another embodiment of the invention clamps configured to reach over rectangular corners formed by adjacent said walls in the assembled state of a container. This means that said walls may by simple means reliably be kept in the mutual position with respect to the bottom member defined by said first part of each said second section.

The invention also relates to a container having a bottom and four lateral walls made from a system according to the present invention as well as a use of a system according to the present invention for producing a container.

Further advantages as well as advantageous features of the invention will appear from the following description.

BRIEF DESCRIPTION OF THE DRAWINGS

With reference to the appended drawings, below follows a specific description of a system for creating a container according to an embodiment of the invention cited as an example.

In the drawings.

DETAILED DESCRIPTION OF AN EMBODIMENT OF THE INVENTION

A system for creating a container having a bottom and four lateral walls according to the present invention will now be described while making reference to FIGS. 1-4. The system comprises a first plate-like member 1, hereinafter bottom member, configured to form a bottom of a container, and four second plate-like members 2, hereinafter walls, configured to form lateral walls of a container. These members are here made of wood, such as plywood, and the bottom member may be independent or a part of or attached upon a pallet. The system comprises in addition thereto an arrangement 3 for interlocking said walls with respect to said bottom member so as to create a container in an assembled state as shown in FIG. 1.

Figure 1:
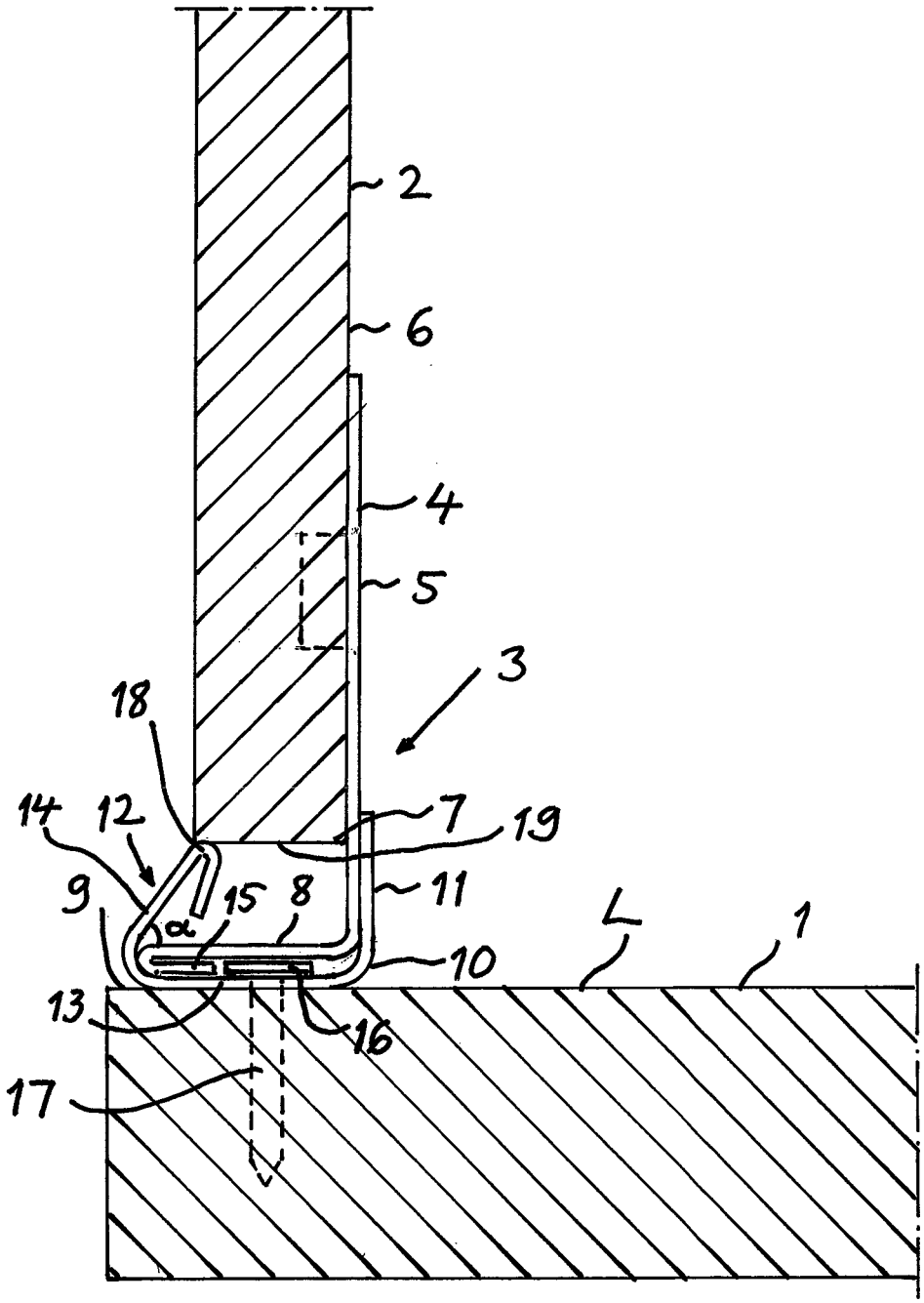
FIG. 1 is a side elevation view of a part of a bottom member and a wall of a container interlocked by an arrangement of a system for creating a container according to the invention in an assembled state of the container.

The interlocking arrangement comprises for each wall 2 a first elongated plate-material section 4 made of an elongated metal plate shaped as shown in FIG. 1. This first section is through a first part 5 thereof secured to a wall surface 6 of said wall 2 to form an inner wall surface of a container in said assembled state while extending along an edge 7 of said wall to form a lower edge of a lateral wall in this assembled state. The first section 4 has a second part 8 connecting to said first part while making an angle therewith of approximately 90°.

The interlocking arrangement comprises in addition thereto for each outer border 9 of the bottom member 1 a second elongated plate-material section 10 made of an elongated metal plate shaped secured to the bottom member while extending along the respective said outer border 9. The second section has a first part 11 extending substantially perpendicularly to a large surface L of the bottom member 1 designed to form a bottom of a container for extending substantially vertically upwards from said surface when placing said bottom member substantially horizontally.

The second section has also a second part 12 configured to allow introduction of the first section into the second section from above, assuming said bottom being placed substantially horizontally, with the corresponding wall tilted outwards from a centre of a container to be created by at least 20° from a vertical extension, to form a stop to said first section preventing lifting of said wall with respect to said bottom member in an vertical position of the former to be obtained upon said introduction by tilting the wall with respect to the bottom member as shown in FIG. 1. The first part 11 of the second section 10 does in that position provide support for the first part 5 of the first section so as to prevent further tilting of the wall 2 than to the vertical position and by that define said assembled state.

Said second part 12 of each second section comprises a mid portion 13 connecting to said first part 11 while extending substantially perpendicularly thereto in a direction outwards from a centre of a container to be created while resting on the bottom member 1 and an end portion 14 connecting to the mid portion opposite to the first part 11, pointing upwards when placing said bottom member substantially horizontally and making an angle α with respect to said bottom member of less than 80°, here approximately 60°, and configured to define said stop for said first section. The second part 8 of the first section has for that sake an extension in the direction away from the first part of the first section being substantially equal to the corresponding extension of said mid portion 13 of the second section. Thus, the second part 8 of the first section 4 will in the assembled state bear upon said mid portion 13 of the second section and has a portion 15 bent back while allowing the head 16 of a screw 17 to be received under single-layered portions of said second part. This "double bent" of the second part of the first section results in an increased strength of the corresponding end of this section and a stable bearing of the first section 4 upon the second section 10 when introduced therein as shown in FIG. 1.

Each second section 10 has a support portion 18 configured to provide support from below to a lower edge surface 19 of a wall 2 in the assembled state. This support portion 18 is formed by an end of the end portion 14 of the second section remote to said mid portion 13 and this end is bent back towards the mid portion for increasing the strength of this end portion.

Figure 2:
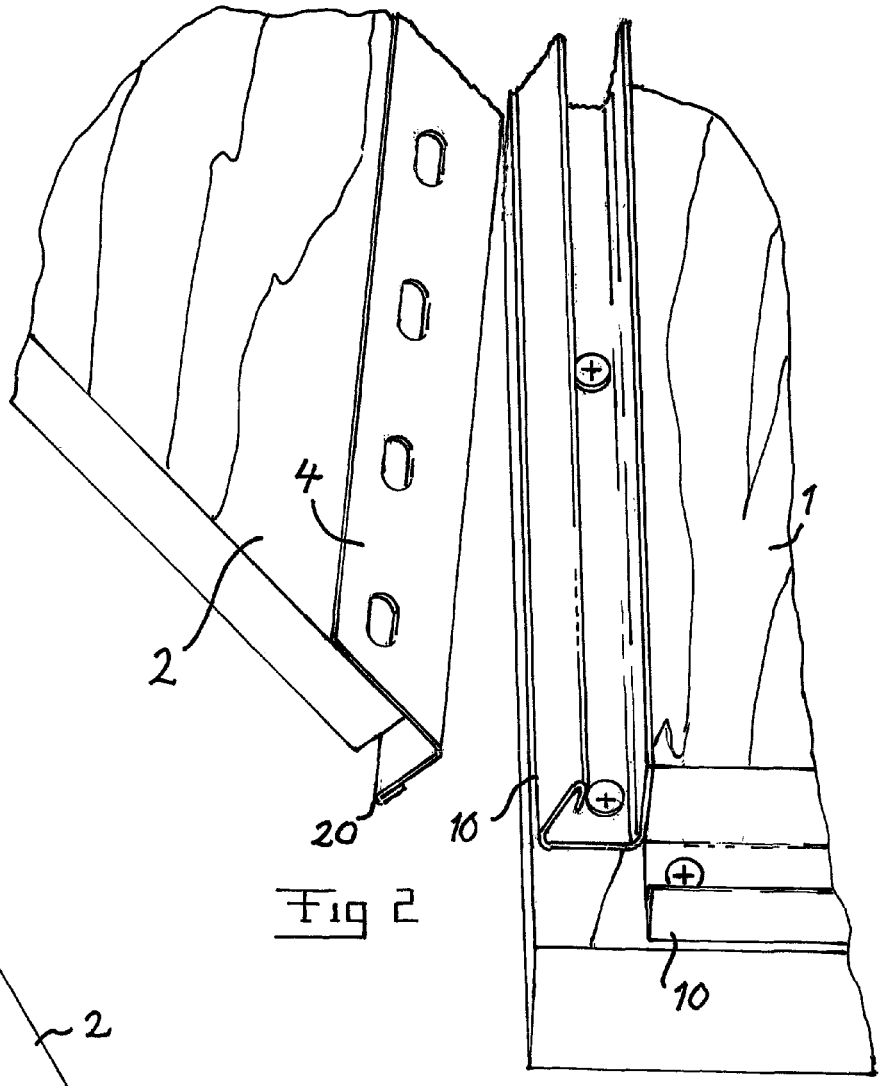
FIG. 2 is a perspective view illustrating how a wall of the container according to FIG. 1 may be approached to the bottom member thereof for assembling them to form a container.
Figure 3:
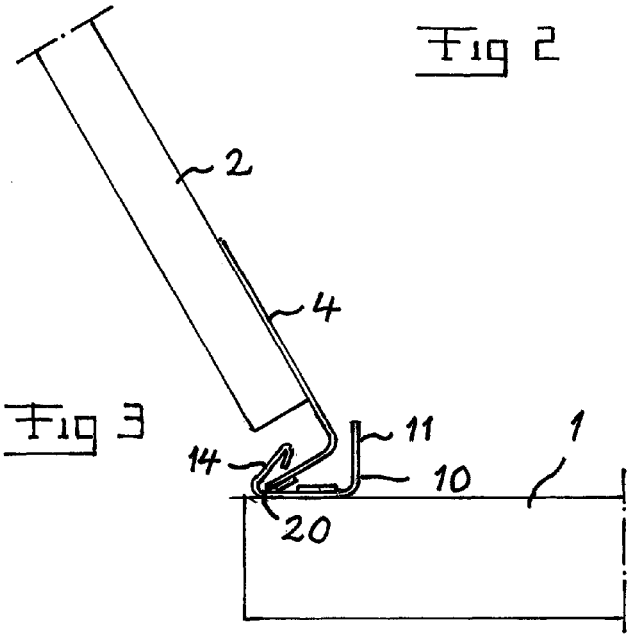
FIG. 3 is a view corresponding to FIG. 1 illustrating how said wall and bottom member are brought into an interlocked state.
Figure 4:
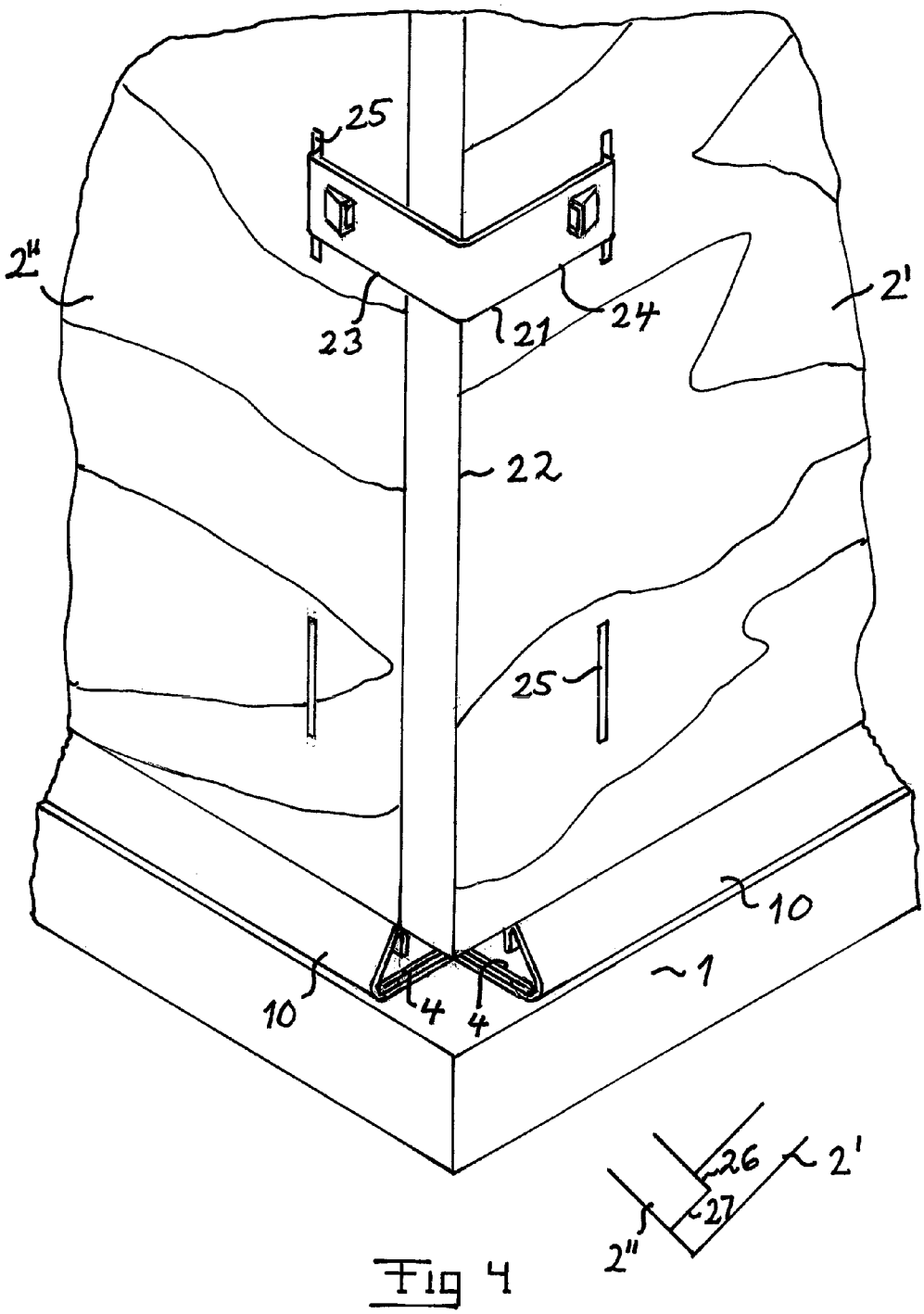
FIG. 4 is a perspective view illustrating how two adjacent walls of a container brought to the position shown in FIG. 1 may be interlocked.

The function of said system for assembly and disassembly of a container will now be described while making reference to FIGS. 1-4. The assembled state is obtained by lifting a wall, as shown in FIG. 2, and keeping it tilted outwards from a centre of a container to be created so as to enable introduction of the first section by the end 20 of the second part thereof into the corresponding second section secured to the bottom member 1. Two walls to form adjacent lateral walls of the container are preferably so connected to the bottom member while extending substantially horizontally with the second part of the first sections pointing downwards. These two walls are then tilted upwards as illustrated in FIG. 3 with said end 20 of the first section "rolling" inside the second section at the transition of the mid portion 13 to the end portion 14 to the position shown in FIG. 1, in which the first part 11 of the second section prevents further such tilting. One of two walls meeting at a corner of a container to be created, here the wall 2', extends to and forms the corner and has closest to the corner a reduced thickness for providing a support surface 26 assisting said first part 11 in preventing further tilting of the other wall 2" as seen in a simplified view of said corner from above at the bottom of FIG. 4. The end surface 27 of the wall 2" will have a corresponding assisting action upon the wall 2'. Other such support assisting means are of course conceivable, such as attaching a wood piece on the inner surface of the wall 2'. Means 21 configured to mutually interconnect adjacent walls in the form of clamps configured to reach over rectangular corners 22 formed by such adjacent walls in the assembled state of the container are then attached to the walls for keeping them against tilting outwards and maintaining the position shown in FIG. 1. The clamps may be of any conceivable type, but it is advantageous that it is clamp with two legs 23, 24 resiliently connected to each other, which may be obtained by manufacturing the clamp of spring steel. The two legs may in a rest position of the clamp with a minimum of potential energy stored therein make an angle with respect to each other being less than 90°, such as 80°. The clamps have here male members at the end of said legs designed to be introduced into female members in the form of grooves 25 in the walls by urging the ends of the legs apart and storing potential energy in the clamp.

When two adjacent walls have been interconnected by one or more such clamps one further wall at the time may be added thereto by introduction of the end 20 of the corresponding first section in a said second section as shown in FIG. 2 and tilting this wall through the position shown in FIG. 3 to the position shown in FIG. 1 and then using one or more clamps for interconnecting the wall with an adjacent wall.

The system may, but does not necessarily, comprise a lid to be arranged upon said walls and secured thereto.

Disassembly of such a container is simply to obtain by carrying out the steps just described in the opposite order. Accordingly, it is started by removing clamps interconnecting a said wall to two adjacent walls and then tilting this wall outwards with respect to the centre of the container to a position in which the end portion 14 of said second section allows lifting of the first section out of the second section. The other three walls may then be removed from the bottom member in a corresponding way.

Thus, assembly and disassembly of a container may be easily obtained while interconnecting and disconnecting the walls with respect to the bottom member by simply moving (tilting and lifting/lowering) the walls with respect to the bottom member. No operation of any screws or other tightening members is necessary for obtaining this.

The invention is of course not in any way restricted to the embodiment described above, but many possibilities to modifications thereof would be apparent to a person with ordinary skill in the art without departing from the scope of the invention as defined in the appended claims.

Quite other means for mutually interconnecting adjacent walls of a container formed by assembling said bottom member and the walls than clamps of the type disclosed above are possible, such as for example a clamp shown in SE 513 684 C2 or means shown in EP 1 810 931 B1.

The invention claimed is:

1. A system for creating a container having a bottom and four lateral walls, said system comprising a first plate-like bottom member (1) forming the bottom of the container, four second plate-like wall members (2) forming the lateral walls of the container, and an arrangement (3) for interlocking said wall members (2) to said bottom member (1) to assemble the container, wherein said arrangement (3) is configured to interconnect said wall members (2) with said bottom member (1) and disconnect said wall members (2) from said bottom member (1) by moving said wall members (2) with respect to said bottom member (1) and comprises a first elongated plate (4) secured to each said wall member (2) and extending along an edge (7) of each said wall member (2) to form a lower edge of each said lateral wall in assembled state, and a second elongated plate (10) secured to the bottom member (1) and extending along a respective outer border (9) of the bottom member (1), each said second plate (10) having a first part (11) extending substantially perpendicularly to a large surface (L) of said bottom member (1) forming the bottom of the container and extending substantially vertically upwardly from said surface (L) when said bottom member (1) is placed substantially horizontally, and a second part (12) allowing said first plate (4) to be introduced into the second plate (10) from above, when said bottom member (1) is placed substantially horizontally and a corresponding wall member (2) is tilted outwardly from a centre of the container being created by at least 20° from vertical, and forming a stop to said first plate (4) preventing lifting of said respective wall member (2) vertically upwardly from said bottom member (1), said first part (11) of the second plate (10) additionally supporting the first plate (4) to prevent further tilting of said respective wall member (2) from vertical and define said assembled state, said first and second plates (4, 10) enable disassembling of the container by tilting said respective wall members (2) outwardly from the bottom member (1) to a position in which said second part (12) of each said second plate (10) allows lifting of said first plate (4) out of said second plate (10), each said second plate (10) is secured from above to the bottom member (1) by screws (17), and the first plate (4) has a first part (5) configured to be secured to a wall surface (6) of each said wall member (2), and a second part (8) bent substantially at a right angle from the first part (5) and having two layers, a top layer and a bottom layer, with an end of the second part (8) of the first plate (4) opposite the first part (5) of the first plate (4) being bent back (15) underneath the top layer of the second part (8) of the first plate (4) to form the bottom layer and terminating at an end underneath the top layer, such that the bottom layer is shorter in length than the top layer, to allow a head (16) of a respective screw (17) to be received underneath the top layer of the second part (8) of the first plate (4) and laterally adjacent the bent back end (15) of the bottom layer of the second part (8) of the first plate (4) and above the second plate (10) in the assembled state.

2. A system according to claim 1, wherein said second part (12) of said second plate (10) is configured to allow said wall member (2) to tilt outwardly from the vertical by at least 40°.

3. A system according to claim 1, wherein said second part (12) of said second plate (10) comprises a mid portion (13) connected to said first part (11) while extending substantially perpendicularly thereto in a direction outwards from a centre of a container to be created while resting on said bottom member (1) and an end portion (14) connected to said mid portion (13) opposite to said first part (11) of said second plate (10), pointing upwardly when placing said bottom member (1) substantially horizontally, making an angle with respect to said bottom member (1) of less than 80° and configured to define said stop for said first plate (4).

4. A system according to claim 3, wherein said first part (5) of said first plate (4) extends along said a wall surface (6) of said wall member (2) downwardly to bear against said first part (11) of said second plate (10) in said assembled state as well as said second part (8) of said first plate (4) connected to said first part (5) of the first plate (4) being configured to bear upon said mid portion (13) of said second plate (10) and extend substantially horizontally in said assembled state, and said end portion (14) of said second plate (10) configured to keep said first plate (4) inside said second plate (10) in the vertical position of the wall member (2) by preventing said second part (8) of the first plate (4) from being lifted with respect to the bottom member (1).

5. A system according to claim 3, wherein each said end portion (14) makes an angle (α) of 80°-40° with said mid portion (13).

6. A system according to claim 1, wherein each said second plate (10) has a support portion (18) configured to provide support from below to a lower edge surface (19) of said wall member (2) in said assembled state.

7. A system according to claim 6, wherein said second part (12) of said second plate (10) comprises a mid portion (13) connected to said first part (11) of said second plate (10) while extending substantially perpendicularly thereto in a direction outwards from a centre of a container to be created while resting on said bottom member (1) and an end portion (14) connected to said mid portion (13) opposite to said first part (11) of said second plate (10), pointing upwardly when placing said bottom member (1) substantially horizontally, making an angle with respect to said bottom member (1) of less than 80° and configured to define said stop for said first plate (4), and said support portion (18) is formed by an end of said end portion (14) remote from said mid portion (13) of said second plate (10).

8. A system according to claim 7, wherein said end portion (14) of said second plate (10) is bent back towards said mid portion (13) for increasing the strength of said end portion.

9. A system according to claim 4, wherein said first part (5) of said first plate (4) is secured to said wall surface (6) to form an inner wall surface of a container in said assembled state.

10. A system according to claim 1, wherein said first and second plates (4, 10) are made of elongated metal plates shaped.

11. A system according to claim 1, additionally comprising means (21) configured for to mutually interconnecting adjacent wall members (2).

12. A system according to claim 11, wherein said means comprise clamps (21) configured to reach over rectangular corners formed by said adjacent wall members (2) in the assembled state of a container.

13. A container having a bottom (1) and four lateral wall members (2), and made from a system according to claim 1.

14. A system according to claim 2, wherein said second part (12) of said second plate (10) is configured to allow said wall member (2) to tilt outwardly from the vertical by at least 60°.

15. A system according to claim 14, wherein said second part (12) of said second plate (10) is configured to allow said wall member (2) to tilt outwardly from the vertical by at least 70°.

16. A system according to claim 5, wherein each said end portion (14) makes an angle (α) of 80°-60° with said mid portion (13).

17. A system according to claim 16, wherein each said end portion (14) makes an angle (α) of 70°-60° with said mid portion (13).

18. A system according to claim 1, wherein said bent end (15) of said second part (8) of said first plate (4) also rests upon said second plate (10) in the assembled state.

* * * * *